US005471813A

United States Patent [19]

Herzog

[11] Patent Number: 5,471,813

[45] Date of Patent: Dec. 5, 1995

[54] BALL PLACER

[76] Inventor: Kenneth J. Herzog, 200 Mill Rd., Riverhead, N.Y. 11901

[21] Appl. No.: 9,144

[22] Filed: Jan. 26, 1993

[51] Int. Cl.[6] ..... B65B 61/00

[52] U.S. Cl. ..... 53/128.1; 53/68; 53/69; 53/76; 53/133.1; 53/309; 53/316; 53/319; 53/325

[58] Field of Search ..... 53/128.1, 129.1, 53/133.1, 133.2, 264, 265, 309, 314, 316, 319, 322, 323, 324, 325, 67, 68, 69, 76, 367

[56] References Cited

U.S. PATENT DOCUMENTS

| | | | |
|---|---|---|---|
| 1,839,918 | 1/1932 | Gustafson | 53/67 |
| 2,821,823 | 2/1958 | Wahl | 53/316 |
| 2,971,306 | 2/1961 | Phillips | 53/128.1 |
| 2,972,846 | 2/1961 | Weller et al. | 53/319 |
| 3,538,672 | 7/1968 | Shields | 53/67 |
| 3,789,572 | 2/1974 | Tschirky | 53/319 X |
| 3,936,991 | 2/1976 | Deix | 53/76 |
| 4,098,058 | 7/1978 | Carrigan et al. | 53/314 X |
| 4,222,214 | 9/1980 | Schultz et al. | 53/309 |
| 4,548,020 | 10/1985 | Rozmus et al. | 53/319 X |

FOREIGN PATENT DOCUMENTS

| | | | |
|---|---|---|---|
| 552720 | 7/1932 | Germany | 53/67 |
| 482965 | 4/1938 | United Kingdom | 53/67 |

*Primary Examiner*—John Sipos
*Assistant Examiner*—Daniel Moon

[57] ABSTRACT

A ball placer device is provided for containers in a capping machine, which consists of a vertical tube assembly mounted to the capping machine to receive a series of balls therein. A feed assembly for the balls is retained above the vertical tube assembly on the capping machine, so that the balls can enter into the vertical tube assembly in a stacked relationship. A conveyor is to carry a series of the containers in upstanding positions under the vertical tube assembly. Each container is of the type having a neck with a collar thereon. A mechanism is for placing each ball from the vertical tube assembly upon each collar on the neck of each container, one at a time, as the containers are carried under the vertical tube assembly by the conveyor. Another mechanism forward of the ball placing mechanism is for pressing each ball into each collar on the neck of each container as the containers are carried along by the conveyor, so that each ball will be rotatively captured by each collar on the neck of each container, for faster flow of the containers on the conveyor.

1 Claim, 2 Drawing Sheets

BALL PLACER

BACKGROUND OF THE INVENTION

The instant invention relates generally to capping machines and more specifically it relates to a ball placer device for containers in a capping machine which provides mechanisms for placing and inserting a ball into a collar on each of a series of the containers in two separate steps of operation.

There are available various conventional capping machines which do not provide the novel improvements of the invention herein disclosed.

SUMMARY OF THE INVENTION

A primary object of the present invention is to provide a ball placer device for containers in a capping machine that will overcome the shortcomings of the prior art devices.

Another object is to provide a ball placer device for containers in a capping machine that contains mechanisms for placing and inserting a ball into a collar on each of a series of the container in two separate steps of operation for a faster flow of the containers on a conveyor.

An additional object is to provide a ball placer device for containers in a capping machine in which the mechanisms are adjustable for changes in size of both the balls and the containers, so that its operation in the capping machine can continue when the balls and the containers are changed.

A further object is to provide a ball placer device for containers in a capping machine that is simple and easy to use.

A still further object is to provide a ball placer device for containers in a capping machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
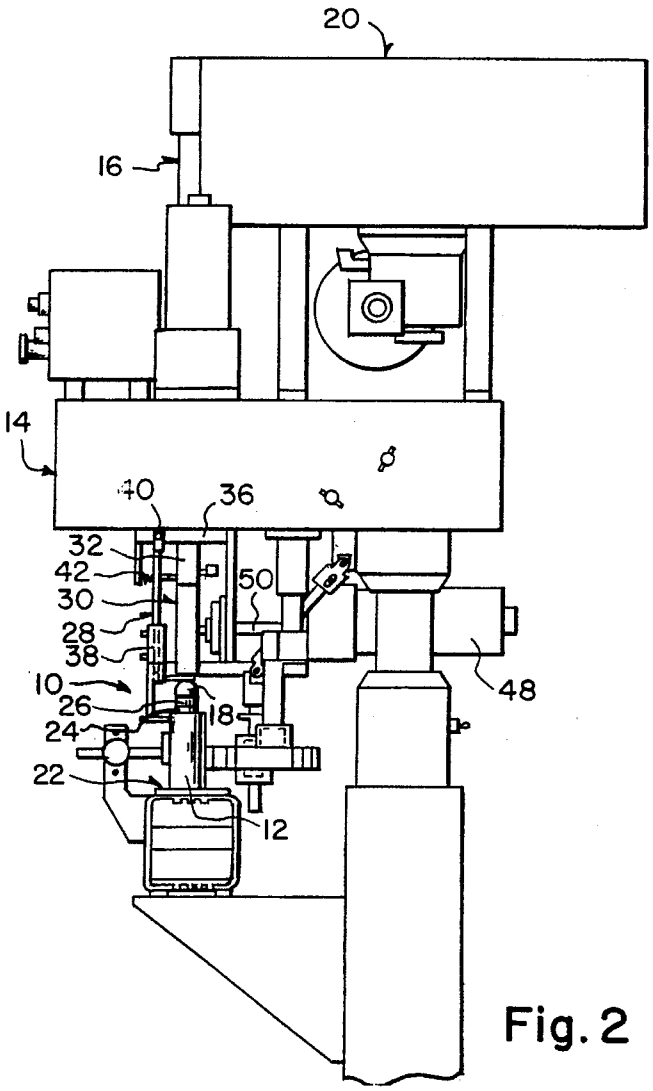
FIG. 2 is a side view taken in direction of arrow 2 in FIG. 1.
Figure 1:
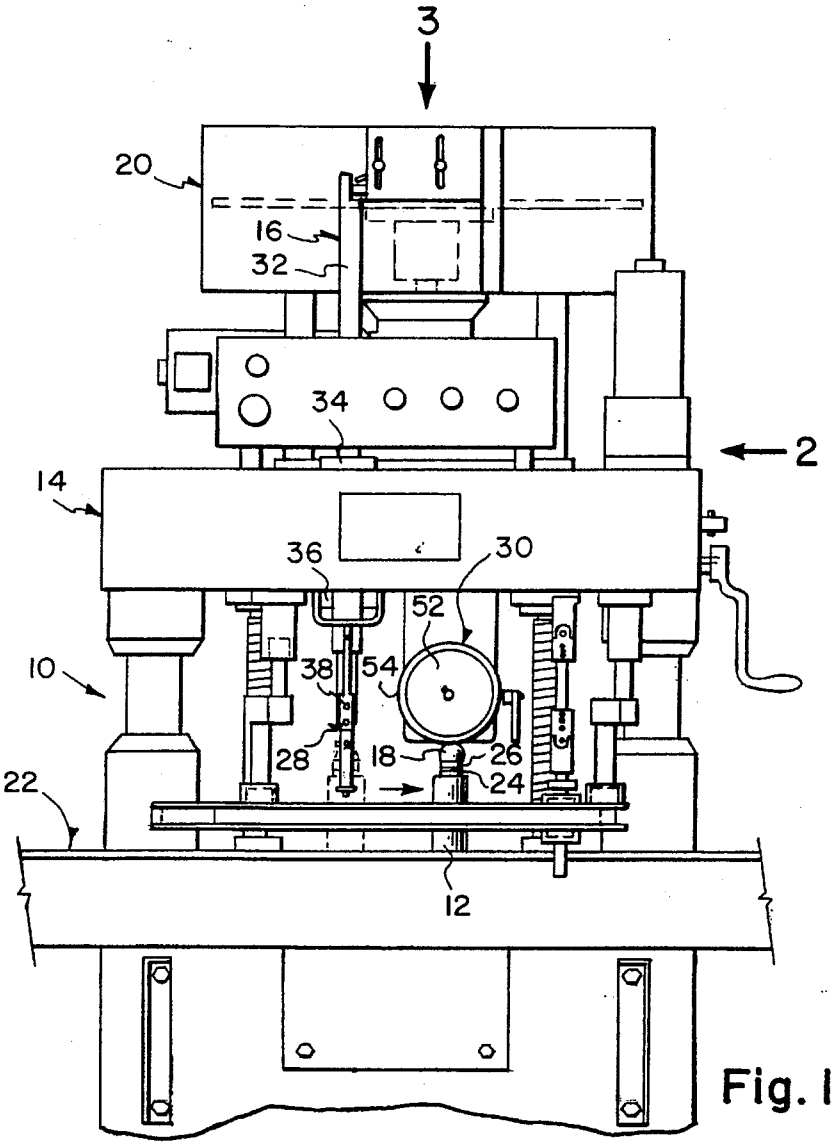
FIG. 1 is a front view of the ball placer device in the capping machine.
Figure 4:
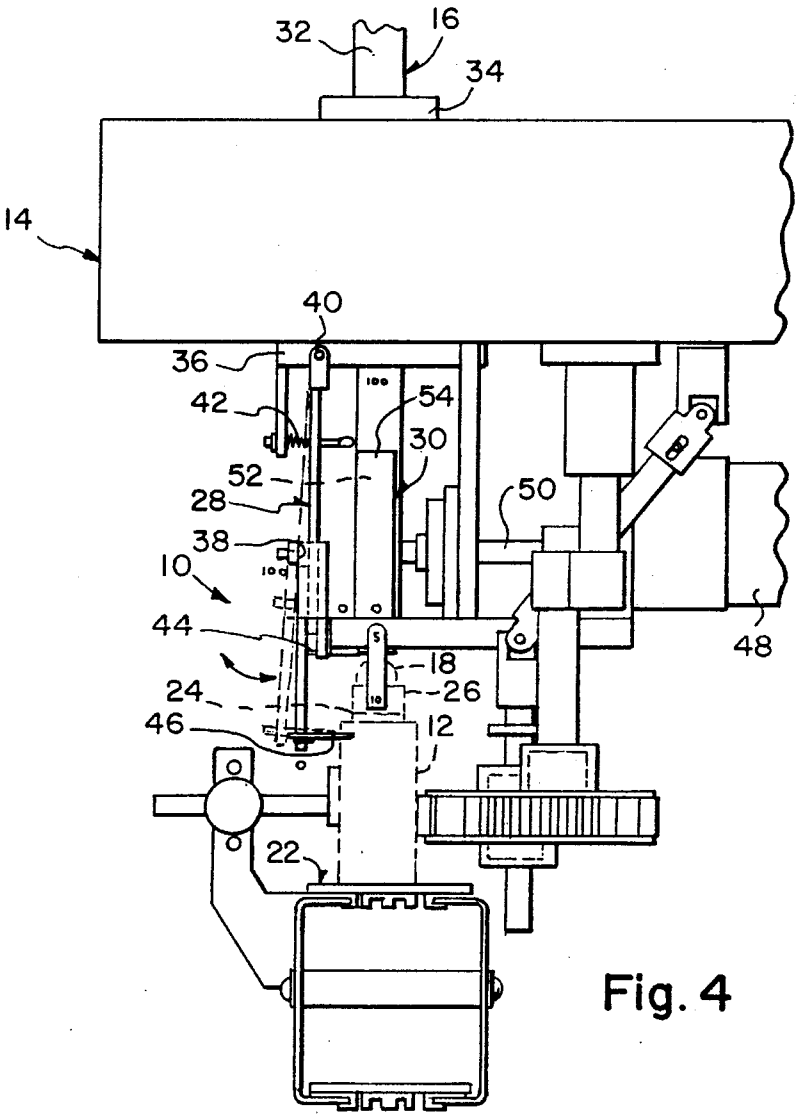
FIG. 4 is an enlarged side view of the ball placer device in greater detail.
Figure 5:
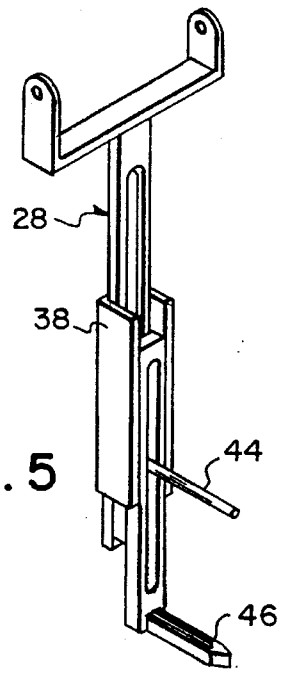
FIG. 5 is a perspective view of the ball release mechanism in greater detail.
Figure 3:
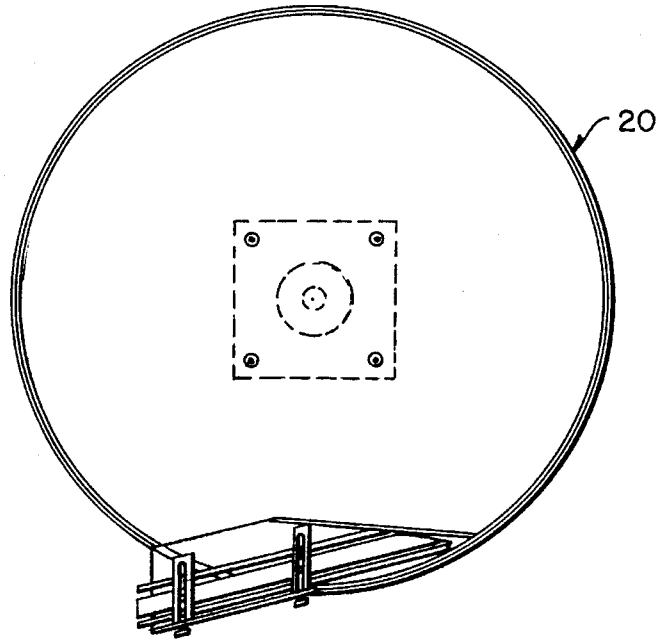
FIG. 3 is a top view taken in direction of arrow 3 in FIG. 1 showing the feed assembly thereof.

Turning now descriptively to the drawings, in which similar reference characters denote similar elements throughout the several views, the Figures illustrate a ball placer device 10 for containers 12 in a capping machine 14, which consists of a vertical tube assembly 16 mounted to the capping machine 14 to receive a series of balls 18 therein. A feed assembly 20 for the balls 18 is retained above the vertical tube assembly 16 on the capping machine 14, so that the balls 18 can enter into the vertical tube assembly 16 in a stacked relationship. A conveyor 22 carries a series of the containers 12 in upstanding positions under the vertical tube assembly 16. Each container 12 is of the type having a neck 24 with a collar 26 thereon. A mechanism 28 is for placing each ball 18 from the vertical tube assembly 16 upon each collar 26 on the neck 24 of each container 12, one at a time, as the containers 12 are carried under the vertical tube assembly 16 by the conveyor 22. Another mechanism 30 forward of the ball placing mechanism 28 is for pressing each ball 18 into each collar 26 on the neck 24 of each container 12, as the containers 12 are carried along by the conveyor 22, so that each ball 18 will be rotatively captured by each collar 26 on the neck 24 of each container 12 for faster flow of the containers 12 on the conveyor 22.

The vertical tube assembly 16 includes an elongated hollow pipe 32 to receive the balls 18 therein. A top mounting plate 34 is for attaching the elongated hollow pipe 32 vertically to the capping machine 14. A bottom mounting plate 36 is for further attaching the elongated hollow pipe 32 vertically to the capping machine 14.

The ball placing mechanism 28 includes a height adjustable Y-shaped bracket 38 pivotally attached at 40 to the bottom mounting plate 36 to hang vertically in front of the elongated hollow pipe 32. A structure 42 is for biasing the Y-shaped bracket 38 towards the elongated hollow pipe 32. A rod 44 extends horizontally from the Y-shaped bracket 38 to go under a distal lower end of the elongated hollow pipe 32. A pointed finger 46 extends horizontally from the Y-shaped bracket 38 below the rod 44 to contact each container 12 carried past the elongated hollow pipe 32, for forcing the rod 44 on the Y-shaped bracket 38 away from the distal lower end of the elongated hollow pipe 32 to allow one ball 18 to drop onto the collar 26 on the neck 24 of the container 12.

The ball pressing mechanism 30 includes a motor 48 mounted to the capping machine 14. The motor 48 has a drive shaft extending therefrom. A wheel 52 is affixed to the drive shaft 50 of the motor 48, so that the wheel 52 will rotate on the drive shaft 50 over the conveyor 22 at the same speed as the conveyor 22. A belt 54 extends about the circumference of the wheel 52, so that the belt 54 will contact with and press each ball 18 into each collar 26 on the neck 24 of each container 12 as the containers 12 are carried along by the conveyor 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ball placer device for containers in a capping machine which comprises:

(a) a vertical tube with a lower end mounted on the capping machine to receive a series of balls therein;

(b) a feed assembly for the balls, retained above said vertical tube on the capping machine, so that the balls can enter into said vertical tube in a stacked relationship;

(c) a conveyor to carry a series of the containers in upstanding positions under said vertical tube towards a ball pressing means, each container of the type having a neck with a collar thereon;

(d) ball placing means for placing each ball consecutively from said vertical tube upon each collar on the neck of each container, one at a time, as the containers are carried under said vertical tube by said conveyor, wherein said ball placing means retains the balls in said tube and is responsive to contact with said containers to release a ball from said lower end of said tube, said ball placing means including:

a bracket pivotally attached to said capping machine vertically spaced from said tube;

means for biasing said bracket towards said tube;

a rod extending from said bracket under said tube lower end retaining said balls in said tube; and a pointed finger extending horizontally from said bracket located to contact each container carried past said tube forcing said rod away from said tube to allow one ball to drop onto the collar on the neck of the container; and (e) ball pressing means downstream of said ball placing means, for pressing each ball into each collar on the neck of each container as the containers are carried along by said conveyor, so that each ball will be rotatively mounted in each said collar.

* * * * *